US007066830B2

(12) United States Patent
Day

(10) Patent No.: US 7,066,830 B2
(45) Date of Patent: Jun. 27, 2006

(54) GOLF CLUB WITH IMPROVED HEAD

(75) Inventor: Michael W. Day, 875 Mahogany Dr., Minden, NV (US) 89423

(73) Assignee: Michael W. Day, Minden, NV (US), 1977 Trust ( * ) Notice: Subject to any disclaimer, the term of this patent is extended or adjusted under 35 U.S.C. 154(b) by 0 days.

(21) Appl. No.: 10/437,125

(22) Filed: May 12, 2003

(65) Prior Publication Data

US 2003/0211901 A1 Nov. 13, 2003

Related U.S. Application Data

(60) Provisional application No. 60/380,435, filed on May 13, 2002.

(51) Int. Cl.
*A63B 53/04* (2006.01)

(52) U.S. Cl. ..... 473/324; 473/330; 473/331

(58) Field of Classification Search ..... 473/324, 473/330, 331, 325–329, 332–350
See application file for complete search history.

(56) References Cited

U.S. PATENT DOCUMENTS

| | | | | |
|---|---|---|---|---|
| 2,023,885 | A * | 12/1935 | Hinckley | 473/559 |
| 4,471,961 | A * | 9/1984 | Masghati et al. | 473/330 |
| D285,473 | S | 9/1986 | Flood | |
| 4,725,062 | A * | 2/1988 | Kinney, III | 473/330 |
| D298,269 | S | 10/1988 | Flood | |
| 5,076,585 | A * | 12/1991 | Bouquet | 473/343 |
| 5,141,231 | A * | 8/1992 | Cox | 473/330 |
| D340,492 | S | 10/1993 | Flood | |
| D350,175 | S | 8/1994 | Motoki | |
| D364,665 | S | 11/1995 | Goodrich | |
| D366,508 | S | 1/1996 | Hutin | |
| D371,408 | S | 7/1996 | Ashcraft et al. | |
| D377,674 | S | 1/1997 | Schmidt et al. | |
| 5,665,014 | A | 9/1997 | Sanford et al. | |
| D390,616 | S | 2/1998 | Maltby | |
| D396,512 | S | 7/1998 | Besnard et al. | |
| D397,748 | S | 9/1998 | Moore | |
| D398,681 | S | 9/1998 | Galy | |
| D398,946 | S | 9/1998 | Kenmi | |
| D401,300 | S | 11/1998 | Albright | |
| D401,650 | S | 11/1998 | Burrows | |
| D402,340 | S | 12/1998 | Sheets et al. | |
| D403,037 | S | 12/1998 | Stone et al. | |
| D405,488 | S | 2/1999 | Burrows | |
| D405,489 | S | 2/1999 | Kubica et al. | |
| D405,855 | S | 2/1999 | Loung | |

(Continued)

*Primary Examiner*—Sebastiano Passaniti
(74) *Attorney, Agent, or Firm*—Thorpe North & Western, LLP

(57) ABSTRACT

A method and apparatus providing a golf club head configured to minimize sliced golf shots. The golf club head includes a club head body having an external surface with a toe portion, a heel portion and a sole portion, the heel portion having a hosel extending therefrom. The club head body also includes a ball striking face disposed between the toe portion and the heel portion, which defines a horizontal center line and a vertical center line located symmetrically on the ball striking face. The ball striking face includes a bulge radius and a roll radius merging to an apex defined to be along an apex angle ranging from approximately 54° to 80° from the vertical center line toward the toe portion and below the horizontal center line. With this arrangement, the position of the apex is configured to minimize sliced golf shots.

20 Claims, 4 Drawing Sheets

U.S. PATENT DOCUMENTS

D410,053 S 5/1999 Wu
D414,231 S 9/1999 Mahaffey
D415,807 S 10/1999 Werner et al.
D418,885 S 1/2000 Wanchena
D424,641 S 5/2000 Sato
6,093,115 A * 7/2000 Murtland et al. ..... 473/330
D428,950 S 8/2000 Galloway et al.
D430,244 S 8/2000 Besnard et al.
6,139,445 A * 10/2000 Werner et al. ..... 473/330
D437,016 S 1/2001 Toyota et al.
D438,583 S 3/2001 O'Doherty et al.
D438,922 S 3/2001 Asabuki
D441,818 S 5/2001 Sato
D441,819 S 5/2001 Helmstetter et al.
D444,830 S 7/2001 Kubica et al.
6,344,002 B1 * 2/2002 Kajita ..... 473/330
6,402,639 B1 * 6/2002 Iwata et al. ..... 473/330
6,454,664 B1 * 9/2002 Long et al. ..... 473/330

* cited by examiner

GOLF CLUB WITH IMPROVED HEAD

Priority is hereby claimed to U.S. Provisional Patent Application Ser. No. 60/380,435 filed on May 13, 2002.

BACKGROUND OF THE INVENTION

1. Field of the Invention

The present invention relates generally to sports equipment such as golf clubs and, more particularly, the present invention relates to an improvement to enhance the performance of a golf participant based on the physical characteristics of the golf club head.

2. State of the Art

Golf is a sport that appeals to golfers of all abilities. Golfers of great, intermediate and beginner abilities typically play with golf clubs that have been structured and modified to compensate for defects in a golfer's golf swing. Such modifications are related to the structure and physics of the golf club head and not necessarily to the materials or process of manufacture used in producing the golf club head. For example, it is known to modify a golf club face, i.e., surface striking the golf ball, to compensate for errors in a golfer's swing, such as a pronounced slice or pronounced hook, and even a lack of distance. For right handed golfers, a slice is a golf shot that includes dramatic side spin causing the ball to curve to the right and further, bounce to the right when hitting the ground. A hook is a shot that includes dramatic side spin causing the ball to curve to the left and bounce to the left when hitting the ground.

Some known modifications to the golf club face for minimizing such slice and hook shots have been implemented by providing a bulge radius to the golf club face. The bulge radius is defined as a curvature to the golf club face from the heel to the toe of the golf club head. Such bulge radius helps to provide correction to the spin of the golf ball hit toward the toe or the heel of the golf club face, thereby, minimizing hooked and/or sliced shots. The bulge radius includes an apex (i.e., highest point of curvature on club face), which in most golf clubs is structured to be at the center of the golf club face.

U.S. Pat. No. 6,093,115, to Murtland et al., discloses several embodiments of a golf club face having one or more bulge radii. In the Murtland et al. reference, the one or more bulge radii each include an apex that is asymmetric to the center of the club face. For example, the apex of one bulge radius is positioned toward the toe end of the golf club and the apex of the other bulge radius is positioned toward the heel end of the golf club. With this arrangement, the apexes are positioned so that the club head compensates for players having a pronounced slice and/or hook tendency in their golf shots.

Unfortunately, defining the radii and providing two different apex locations lead to a complicated formula for defining the golf club face. Further, although the Murtland et al. reference addresses modifications that can compensate for the faults in a golfer's golf swing, there are further modifications that can be made to the club face to further compensate and enhance the golf shots for golfers.

SUMMARY OF THE INVENTION

The present invention relates to a method and apparatus providing a golf club head configured to minimize sliced golf shots. The golf club head includes a club head body having an external surface with a toe portion, a heel portion and a sole portion, the heel portion having a hosel extending therefrom. The club head body also includes a ball striking face disposed between the toe portion and the heel portion, which defines a horizontal center line and a vertical center line located symmetrically on the ball striking face. The ball striking face includes a bulge radius and a roll radius merging to an apex defined to be along an apex angle ranging from approximately 54° to 80° from the vertical center line toward the toe portion and below the horizontal center line. With this arrangement, the position of the apex is configured to minimize sliced golf shots.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

While the specification concludes with claims particularly pointing out and distinctly claiming that which is regarded as the present invention, the advantages of this invention may be ascertained from the following description of the invention when read in conjunction with the accompanying drawings, in which:

FIG. 2(*a*) illustrates a partial cross-sectional top view of the golf club head, depicting a bulge radius defining a bulge radius apex on the ball striking face of the golf club head;

FIG. 2(*b*) illustrates a partial cross-sectional side view of the golf club head, depicting a roll radius defining a roll radius apex on the ball striking face of the golf club head;

DETAILED DESCRIPTION

Figure 1:
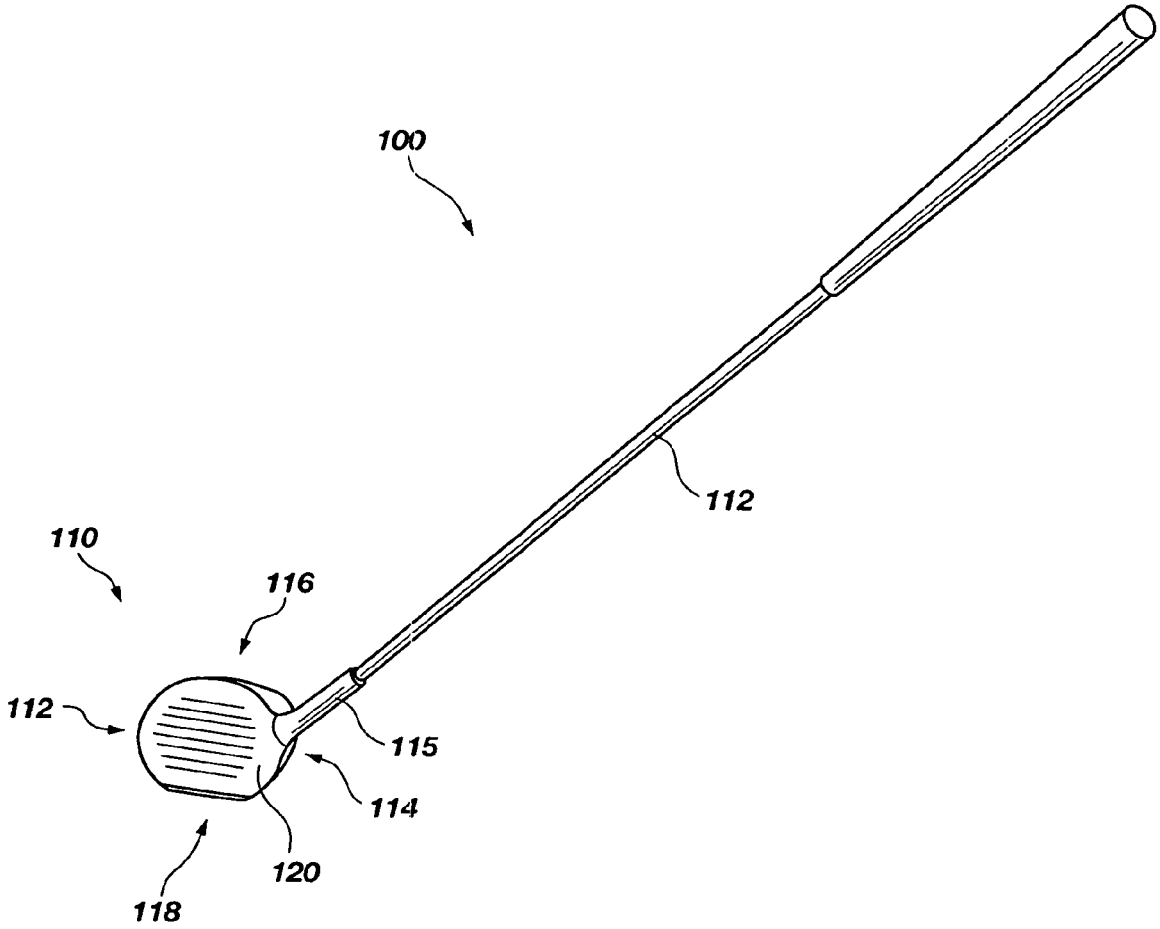
FIG. 1 illustrates a perspective view of a golf club having a golf club shaft coupled to a golf club head, according to an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

FIG. 1 illustrates a golf club 100 having a golf club head 110, such as a wood type and/or metalwood type golf club head. Such a golf club head 110 is configured for driving a golf ball from a tee-box and/or configured as a fairway wood, i.e., one wood, three wood, five wood, etc. The golf club head includes a toe portion 112, a heel portion 114, an upper portion 116 and a sole portion 118. The heel portion of the golf club head includes a hosel 115 extending therefrom which is configured to receive an end portion of a golf club shaft 102. The golf club head 110 further includes a ball striking face 120 at a front portion of the golf club head disposed between the toe portion 112 and the heel portion 114 of the golf club head 110.

The golf club head 110 can be fabricated from any suitable golf club head materials as known to one of ordinary skill in the art, such as, wood, various metals, metal alloys, composite materials, or any suitable combination thereof. Further, the golf club shaft 102 can also be fabricated from any suitable shaft materials, such as, stainless steel or composite materials such as graphite, or both, as known to one of ordinary skill in the art.

Figure 2:
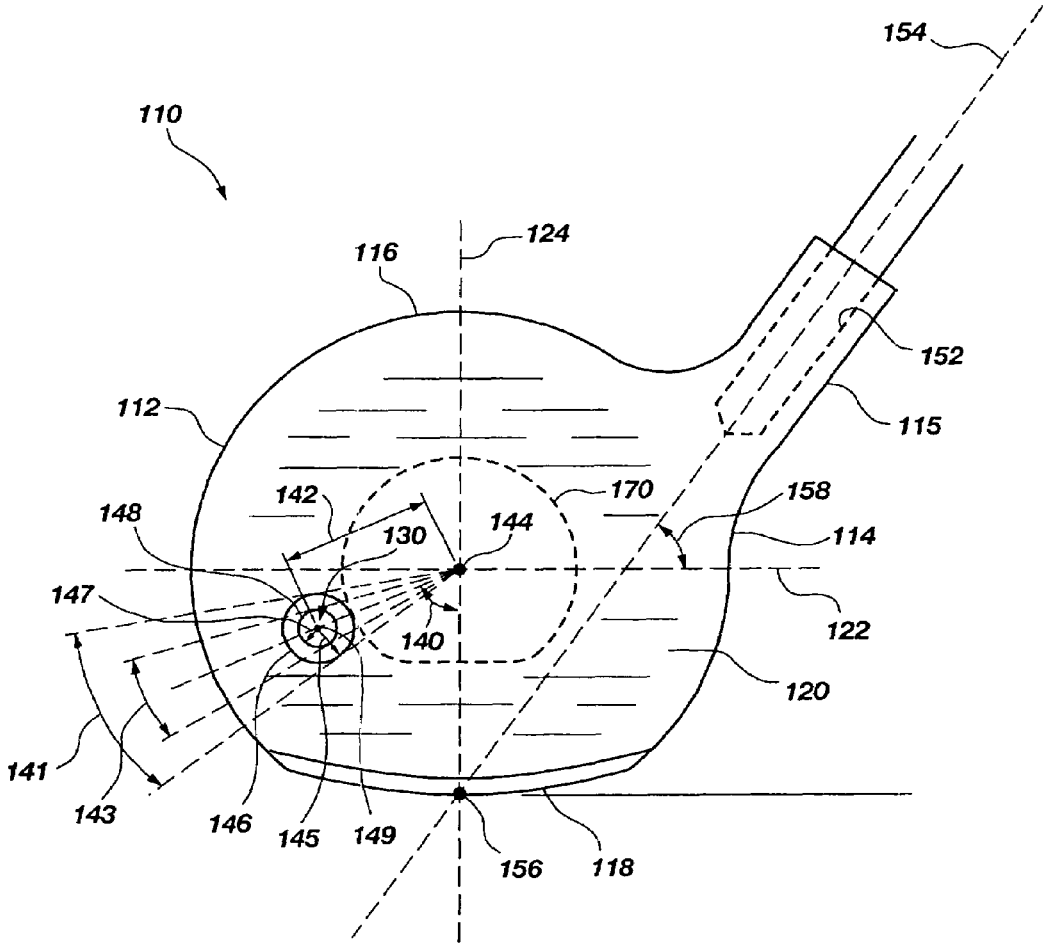
FIG. 2 illustrates a front view of a ball striking face of the golf club head, depicting an apex defined within an apex region and depicting a hosel axis oriented to extend through the vertical center line at a sole portion of the golf club head, according to an embodiment of the present invention.
Figure 2A:
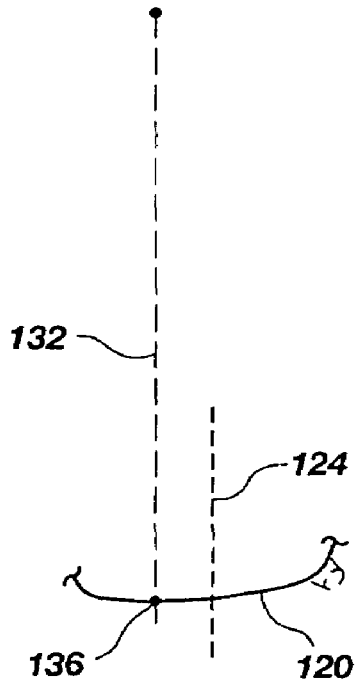
Figure 2B:
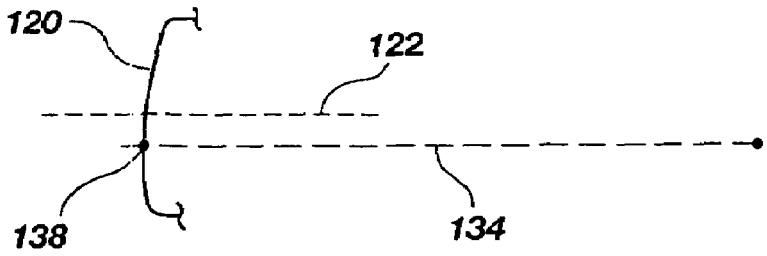

With respect to FIGS. 2, 2(*a*) and 2(*b*), the ball striking face 120 can include, but is not limited to, a substantially circular periphery with a lower portion thereof adjacent the sole portion 118 having a larger radius of curvature. Such circular surface area can include a diameter that ranges from 2.8 inches to 4.0 inches, and a smaller range of 3.0 inches to 3.6 inches, with 3.4 inches being preferred. Due to the lower portion adjacent to the sole portion 118 having a larger radius of curvature, the height of the ball striking face 120 can be less than the width of such ball striking face 120.

The ball striking face 120 defines a horizontal center line 122 and a vertical center line 124 each symmetrically defined and located on the ball striking face 120. The ball striking face 120 of the present invention can include an apex 130 defined to be offset from the vertical center line 124 toward the toe portion 112 and below the horizontal center line 122. Such an apex 130 can be defined with a bulge radius 132 (FIG. 2(*a*)) and a roll radius 134 (FIG. 2(*b*)) each merging to form the apex 130 on the ball striking face 120.

With respect to FIG. 2(*a*), the bulge radius 132 is defined as the radial curvature of the ball striking face 120 between the heel portion 114 and the toe portion 112 of the golf club head 110. The highest point of such bulge radius 132 along the ball striking face 120 is defined as a bulge radius apex 136. Such bulge radius apex 136 of the present invention can be offset from the vertical center line 124 toward the toe portion 112. The bulge radius 132 can include any suitable bulge radius range, such as eight inches to twenty-four inches, but preferably includes a range between approximately eight inches to ten inches, with a preferred bulge radius of 8.84 inches.

With respect to FIG. 2(*b*), the roll radius 134 is defined as the radial curvature of the ball striking face 120 between the upper portion 116 and the sole portion 118 of the golf club head 110. Similar to the bulge radius 132, the highest point of the roll radius 134 along the ball striking face 120 is defined as the roll radius apex 138. The roll radius apex 138 can be offset below the horizontal center line 122 toward the sole portion 118. The roll radius 134 can include any suitable roll radius range, such as eight inches to twenty-four inches, but preferably includes a range between approximately eight inches to ten inches, with a preferred roll radius of 8.84 inches.

Referring again to FIGS. 2, 2(*a*) and 2(*b*), the bulge radius apex 136 and the roll radius apex 138 merge together to form the apex 130 of the ball striking face 120. As such, the ball striking face 120 includes, at least partially, a generally spherical shaped surface. In one embodiment, such an apex 130 can be located along any suitable apex angle 140 ranging within a first apex angle range 141 from approximately 54° to 80° from the vertical center line 124 toward the toe portion 112 and below the horizontal center line 122 and, preferably, along any suitable apex angle 140 ranging within a second apex angle range 143 from approximately 58.5° to 75.5°. In another embodiment, the apex 130 can be located along an apex angle 140 of approximately 67° and defined a distance 142 of approximately 0.94 inches from an intersection 144 of the horizontal and vertical center lines 122 and 124 along the apex angle 140.

In another embodiment, the apex 130 can be at any location within a first circular apex region 146 located between the first apex angle range 141. Such a first circular apex region 146 can include, but is not limited to, a circle or ellipse shape. The first circular apex region 146 can include a first radial distance 145 defined between a center point 149 and a periphery of the first circular apex region 146. The first radial distance 145 can be, but is not limited to, approximately 0.217 inches and the center point can be located, but is not limited to, the distance of approximately 0.94 inches from the intersection 144 of the horizontal and vertical center lines 122 and 124 along the apex angle 140. The first radial distance 145 can be constant for a circle shaped apex region and can vary for an ellipse shaped apex region.

In another embodiment, similar to the previous embodiment, the apex 130 can be at any location within a second circular apex region 148, which is located between the second apex angle range 143. The second circular apex region 148 can include a second radial distance 147 defined between the center point 149 and a periphery of the second circular apex region 148. Such a second radial distance 147 can be, but is not limited to, approximately 0.14 inches with the center point 149 located the distance of approximately 0.94 inches, as set forth in the previous embodiment. Also, the second radial distance 147 can be constant for a circle shaped apex region and can vary for an ellipse shaped apex region.

It can be well appreciated by one of ordinary skill in the art that the optimal apex 130 locations previously set forth are based on the dimensions of the golf club head 110 set forth herein. However, changing such dimensions of the golf club head 110 can change the optimal location of the apex 130 on the ball striking face 120. For example, increasing or decreasing the golf club head size and/or the ball striking face size can change the optimal apex location and apex regions. Further, changing the golf club head to the more traditional oval shaped, or non-circular shaped, ball striking face can change the optimal apex location and apex regions. As such, the present invention provides that the optimal apex 130 location can be along any suitable apex angle 140 ranging within a first apex angle range 145 from approximately 54° to 80° from the vertical center line 124 toward the toe portion 112 and below the horizontal center line 122 and, preferably, along any suitable apex angle 140 ranging within a second apex angle range 143 from approximately 58.5° to 75.5°. With this arrangement, the location of the apex 130 is configured to compensate for faults in a golfer's golf swing and/or a golfer's miss-hits to substantially minimize sliced golf shots.

With respect to FIG. 2, the hosel 115 is configured to extend from the heel portion 114 of the golf club head 110. Such hosel 115 includes a hosel opening 152 defined therein configured to receive an end of the golf club shaft 102 (FIG. 1). The hosel 115 opening includes a hosel axis 154 operable to coincide with a shaft axis (not shown) and operable to orient the golf club shaft 102 with respect to the golf club head 110. The hosel axis 154 can be configured to be oriented and directed toward a sole center line 156 defined by the vertical center line 124 and the sole portion 118 of the golf club head 110. Such orientation of the hosel axis 154 oriented and directed toward the sole center line 156 can include a hosel angle 158 ranging from, but not limited to, approximately 53° to 57° with a preferred angle of 55°. With this arrangement, the hosel angle 158 controls the orientation of the golf club shaft 102 with respect to the golf club head 110 and, more specifically, with respect to the angle of orientation of the sole portion 118 of the golf club head 110.

The golf club head 110 of the present invention can be an enlarged or an over-sized club head with a volume that can range from, but is not limited to, approximately 300 to 420 cubic-centimeters, with a preferred volume of 380 cubic-centimeters. The enlarged golf club head 110 with the circular shape of the ball striking face 120 provides a corresponding circular shaped forgiveness zone 170 much larger than golf club heads having a non-circular ball striking face. The area of the forgiveness zone 170 as a percentage of the total area of the ball striking face 120 is approximately 35%, which is much larger in comparison to the non-circular ball striking faces in the prior art with a forgiveness zone of less than 25% of the total face area. The forgiveness zone 170 is the area of the ball striking face 120 where the golf ball is desired to be struck as it provides the most optimal ball flight path in both direction and distance. With the larger forgiveness zone 170 of the present invention, there is greater potential for the golfer to obtain optimal carrying distance and accuracy in golf shots. Additionally, the circular ball striking face 120 has an increased and more proportional elastic response to the ball striking thereon. The greater elastic performance provides a trampoline effect or rebound that transfers more energy to the golf ball upon contact, thus increasing ball travel distance. Typically, this increased trampoline effect can also result in magnifying a miss hit, such as a slice, and drive the ball even further off line, however, the location of the apex 130 is configured to compensate for such miss hits.

Figure 3:
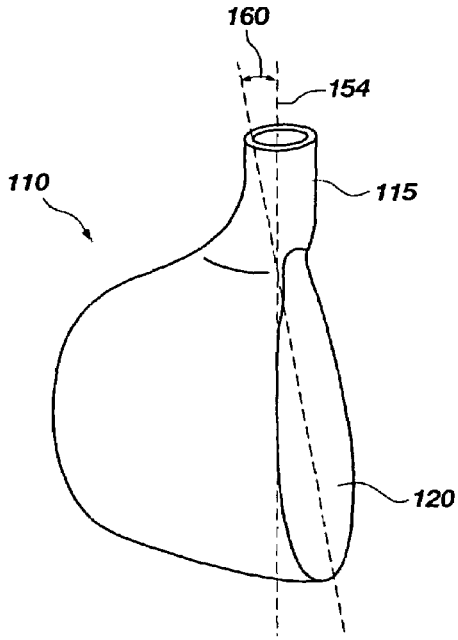
FIG. 3 illustrates a perspective top view of the golf club head, depicting a hosel having an off-set forward orientation and the ball striking face having a closed face orientation, according to another embodiment of the present invention.
Figure 4:
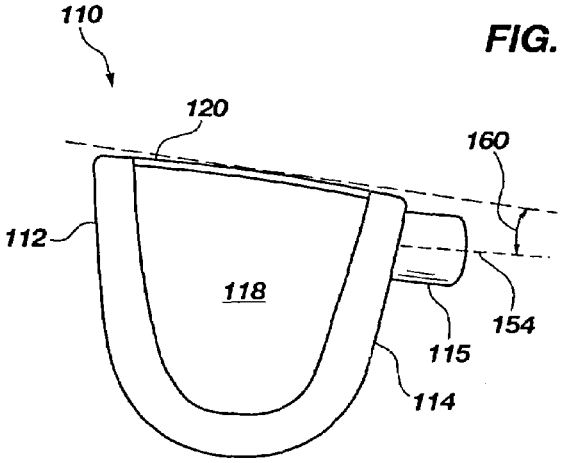
FIG. 4 illustrates a bottom view of the golf club head, depicting another view of the closed face orientation of the golf club head.

Referring now to FIGS. 3 and 4, the hosel 115 can be configured to extend from the heel portion 114 of the golf club head 110. Such a hosel 115 can be configured with an offset forward arrangement, as depicted, or any other suitable hosel arrangement, such as centered and in-set hosel arrangements. With respect to the hosel axis 154 of such off-set forward arrangement, the ball striking face 120 of the golf club head 110 can be angled inward with a closed face angle 160 so as to close the ball striking face 120 with respect to the orientation of the heel portion 114 and the toe portion 112. The closed face angle 160 can range from, but is not limited to, approximately 8° to 10°, with 9° being preferred.

Figure 5:
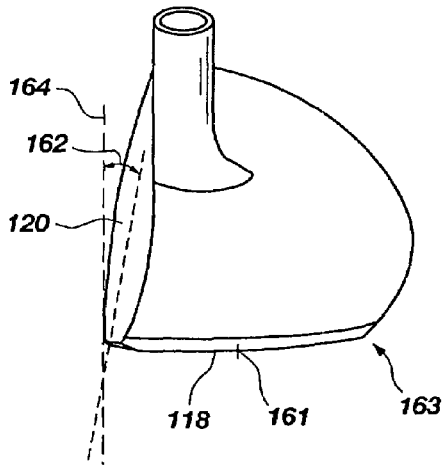
FIG. 5 illustrates a side view of the golf club head, depicting the ball striking face oriented with a vertical loft angle.

With reference to FIGS. 4 and 5, the sole portion 118 can include a generally U-shaped configuration or any other suitable sole configuration known in the art. Such sole portion 118 can extend generally planar from the ball striking face 120 to about a halfway point 161 of the sole portion 118. At about the half way point 161, the sole portion 118 can include a curved orientation extending to a back-end 163 of the sole portion 118 with a radius of curvature of about eleven inches.

With reference to FIG. 5, the ball striking face 120 can include a vertical loft angle 162 defined between the ball striking face 120 and vertical line 164. Such vertical loft angle 162 can range from approximately 8° to 12°, with a preferred range of approximately 9° to 10°. With such vertical loft angle 162, the hosel axis 154 can be oriented and directed toward the sole portion 118 behind the ball striking face 120 and, more specifically, toward the sole center line 156 as previously set forth and described in FIG. 2.

It is to be understood that the above-referenced arrangements are only illustrative of the application for the principles of the present invention. Numerous modifications and alternative arrangements can be devised without departing from the spirit and scope of the present invention while the present invention has been shown in the drawings and fully described above with particularity and detail in connection with what is presently deemed to be the most practical and preferred embodiments(s) of the invention, it will be apparent to those of ordinary skill in the art that numerous modifications can be made without departing from the principles and concepts of the invention as set forth in the claims.

What is claimed is:

1. A golf club head configured to minimize sliced golf shots, comprising:

a club head body having an external surface including a toe portion, a heel portion and a sole portion, the heel portion having a hosel extending therefrom and operable to be coupled to a golf club shaft;

a ball striking face disposed between the toe portion and the heel portion and defining a horizontal center line and a vertical center line located symmetrically on the ball striking face, said ball striking face including a bulge radius and a roll radius merging to an apex defined to be along an apex angle ranging from approximately 54° to 80° from the vertical center line toward the toe portion and below the horizontal center line; and wherein said hosel defines a hosel axis oriented and directed to extend toward a sole center line defined by the vertical center line and the sole portion of the golf club head.

2. The golf club of claim 1, wherein said apex is positioned within a circular apex region having a center located 0.94 inches from an intersection of the vertical center line and the horizontal center line.

3. The golf club of claim 2, wherein said apex angle ranges from approximately 58.5° to 75.5° from the vertical center line toward the toe portion and below the horizontal line.

4. The golf club of claim 1, wherein said roll radius comprises a radius curvature ranging from approximately 8 inches to 10 inches.

5. The golf club of claim 1, wherein said bulge radius comprises a radius curvature ranging from approximately 8 inches to 10 inches.

6. The golf club of claim 1, wherein said hosel axis includes a hosel angle ranging from approximately 53° to 57° with respect to the horizontal center line.

7. The golf club of claim 1, wherein said ball striking face includes a substantially circular periphery.

8. The golf club of claim 1, wherein said ball striking face includes a substantially circular periphery.

9. A golf club head configured to minimize sliced golf shots, the golf club head comprising:

a club head body having an external surface including a toe portion, a heel portion and a sole portion, the heel portion having a hosel extending therefrom; and a ball striking face disposed between the toe portion and the heel portion and defining a horizontal center line and a vertical center line located symmetrically on the ball striking face, said ball striking face including a bulge radius and a roll radius merging to an apex defined to be along an apex angle ranging from approximately 54° to 80° from the vertical center line toward the toe portion and below the horizontal center line.

10. The golf club of claim 9, wherein said apex is positioned within a circular apex region having a center located 0.94 inches from an intersection of the vertical center line and the horizontal center line.

11. The golf club of claim 10, wherein said apex angle ranges from approximately 58.5° to 75.5° from the vertical center line toward the toe portion and below the horizontal line.

12. The golf club of claim 9, wherein said roll radius comprises a radius curvature ranging from approximately 8 inches to 10 inches.

13. The golf club of claim 9, wherein said bulge radius comprises a radius curvature ranging from approximately 8 inches to 10 inches.

14. The golf club of claim 9, wherein said hosel defines a hosel axis oriented and directed to extend toward a sole center line defined by the vertical center line and the sole portion of the golf club head.

15. The golf club of claim 14, wherein said hosel axis includes a hosel angle ranging from approximately 53° to 57° with respect to the horizontal center line.

16. The golf club head of claim 9, wherein said hosel defines a hosel axis oriented and directed to extend through the heel portion of the club head and to intersect the sole portion on a heelward side of a sole center line defined by the vertical center line and the sole portion of the golf club head.

17. A method of making a golf club head configured to minimize sliced golf shots, the method comprising:

forming a club head body having an external surface including a toe portion, a sole portion and a heel portion with a hosel extending from the heel portion;

forming said club head body to include a ball striking face disposed between the toe portion and the heel portion and defining a horizontal center line and a vertical center line located symmetrically on the ball striking face; and configuring said ball striking face to include a bulge radius and a roll radius merging to an apex defined along an apex angle ranging from approximately 54° to 80° from the vertical center line toward the toe portion and below the horizontal center line.

18. The method of claim 17, wherein said configuring comprises configuring said apex to be positioned within a circular apex region having a center located 0.94 inches from an intersection of the vertical center line and the horizontal center line.

19. The method of claim 18, wherein said configuring said ball striking face comprises configuring said apex angle to range from approximately 58.5° to 75.5° from the vertical center line toward the toe portion and below the horizontal line.

20. The method of claim 17, further comprising configuring said hosel to receive a club shaft with an axis oriented and directed toward a sole center line defined by the vertical center line and the sole portion of the club head body.

* * * * *